US008575826B1

(12) United States Patent
Huang

(10) Patent No.: US 8,575,826 B1
(45) Date of Patent: Nov. 5, 2013

(54) CONNECTION STRUCTURE OF LED LAMP HOLDER AND HEAT RADIATION FINS

(76) Inventor: Tsung-Hsien Huang, I-Lan Hsien (TW)

( * ) Notice: Subject to any disclaimer, the term of this patent is extended or adjusted under 35 U.S.C. 154(b) by 0 days.

(21) Appl. No.: 13/546,311

(22) Filed: Jul. 11, 2012

(30) Foreign Application Priority Data

Apr. 24, 2012 (CN) ..... 2012 1 0121484

(51) Int. Cl.
*H01J 1/02* (2006.01)

(52) U.S. Cl.
USPC ..... 313/46; 362/294

(58) Field of Classification Search
USPC ..... 313/46; 362/294
See application file for complete search history.

(56) References Cited

U.S. PATENT DOCUMENTS 7,674,015 B2 * 3/2010 Chien ..... 362/294
8,227,960 B2 * 7/2012 Huang ..... 313/46
2007/0230186 A1 * 10/2007 Chien ..... 362/294
2009/0279314 A1 * 11/2009 Wu et al. ..... 362/373
2011/0221323 A1 * 9/2011 Huang ..... 313/46

FOREIGN PATENT DOCUMENTS

CN M419033 U 12/2011

* cited by examiner

*Primary Examiner* — Mary Ellen Bowman
(74) *Attorney, Agent, or Firm* — Pai Patent & Trademark Law Firm; Chao-Chang David Pai

(57) ABSTRACT

A connection structure of an LED lamp holder and heat radiation fins includes a heat radiation fin module, a heat radiation core pipe and an insulation connector. The heat radiation fin module includes a plurality of heat radiation fins surrounding the heat radiation core pipe. Each heat radiation fin has an insertion portion and a stop tab at a distal end thereof. The insulation connector includes a plurality of engaging hooks and engaging holes around an opening corresponding to the heat radiation fins. The heat radiation fins are coupled to the heat radiation core pipe. The insertion portions of the heat radiation fins hold against the engaging hooks and are inserted in the engaging holes of the insulation connector. The stop tab of each heat radiation fin holds against the respective engaging hook so that the insulation connector and the heat radiation fins are connected quickly.

8 Claims, 11 Drawing Sheets

CONNECTION STRUCTURE OF LED LAMP HOLDER AND HEAT RADIATION FINS

BACKGROUND OF THE INVENTION (a) Field of the Invention

The present invention relates to a connection structure of an LED lamp holder and heat radiation fins and more particularly to a connection structure for connecting the insulation connector and the heat radiation fins quickly.

(b) Description of the Prior Art

As shown in FIG. 12 and FIG. 13, a conventional LED lamp holder comprises a heat radiation fin module 100, a heat radiation core pipe 200 and an insulation connector 300. The heat radiation fin module 100 comprises a plurality of heat radiation fins 101 surrounding the heat radiation core pipe 200. Each heat radiation fin 101 has a fastening neck portion 102 at a distal end thereof. The fastening neck portion 102 is a recess. The insulation connector 300 has an engaging groove 301 formed on the inner wall of an opening thereof. The insulation connector 300 made of ceramic or plastic is connected to the distal end of the heat radiation module 100 by the engaging groove 301 to engage with the fastening neck portion 102. However, the engagement of the engaging groove 301 of the insulation connector 300 and the fastening neck portion 102 of the heat radiation fin 101 constitutes a point contact. For each heat radiation fin 101, it only provides a side point contact and the contact area is very small so the heat radiation fin 101 may be deformed easily. For the insulation connector 300, it doesn't have an axial fixing effect. Thus, the insulation connector 300 may be displaced relative to the heat radiation module 100 to cause damage of the LED lamp holder.

Taiwanese Utility Model No. M419033 discloses a positioning structure of an LED socket and a heat radiation module, which uses an elastic member to fasten the fastening neck portion of the heat radiation fins. After that, the heat radiation fins are inserted in the engaging groove of the insulation connector. Each heat radiation fin also provides a side point contact with the insulation connector and doesn't have an axial fixing effect.

Accordingly, the present invention is intended to provide a connection structure of an LED lamp holder and heat radiation fins for overcoming the shortcomings mentioned above.

SUMMARY OF THE INVENTION

The primary object of the present invention is to provide a connection structure of an LED lamp holder and heat radiation fins. The connection structure comprises a heat radiation fin module, a heat radiation core pipe and an insulation connector. The heat radiation fin module comprises a plurality of heat radiation fins surrounding the heat radiation core pipe. Each heat radiation fin has an insertion portion and a stop tab at a distal end thereof. The insulation connector comprises a plurality of engaging hooks and engaging holes around an opening corresponding to the heat radiation fins. The heat radiation fins are coupled to the heat radiation core pipe. The insertion portions of the heat radiation fins hold against the engaging hooks and are inserted in the engaging holes of the insulation connector. The stop tab of each heat radiation fin holds against the respective engaging hook so that the insulation connector and the heat radiation fins are connected quickly.

In a preferred embodiment of connection structure of an LED lamp holder and heat radiation fins, the stop tab of each heat radiation fin is bent about 90 degrees, so that an end surface of the stop tab holds against the respective engaging hook when the heat radiation fins are engaged with the engaging hooks of the insulation connector. In this way, each heat radiation fin has a contact surface with the insulation connector, providing a better contact effect. The stop tabs of the heat radiation fins surround the opening of the insulation connector with the end surfaces of the stop tabs to form an annular holding contact. This can greatly increase the contact area of the heat radiation fin module and the insulation connector to achieve a stable engagement, and each heat radiation fin won't be deformed.

In the preferred embodiment of the present invention, the insertion portions of the heat radiation fins hold against the engaging hooks and are inserted in the engaging holes of the insulation connector at the same time to provide an axial fixing effect, so that and the heat radiation fins won't be displaced relative to the insulation connector to prevent the LED lamp holder from being damaged because of displacement of the insulation connector.

DETAILED DESCRIPTION OF THE PREFERRED EMBODIMENTS

Embodiments of the present invention will now be described, by way of example only, with reference to the accompanying drawings.

Figure 1:
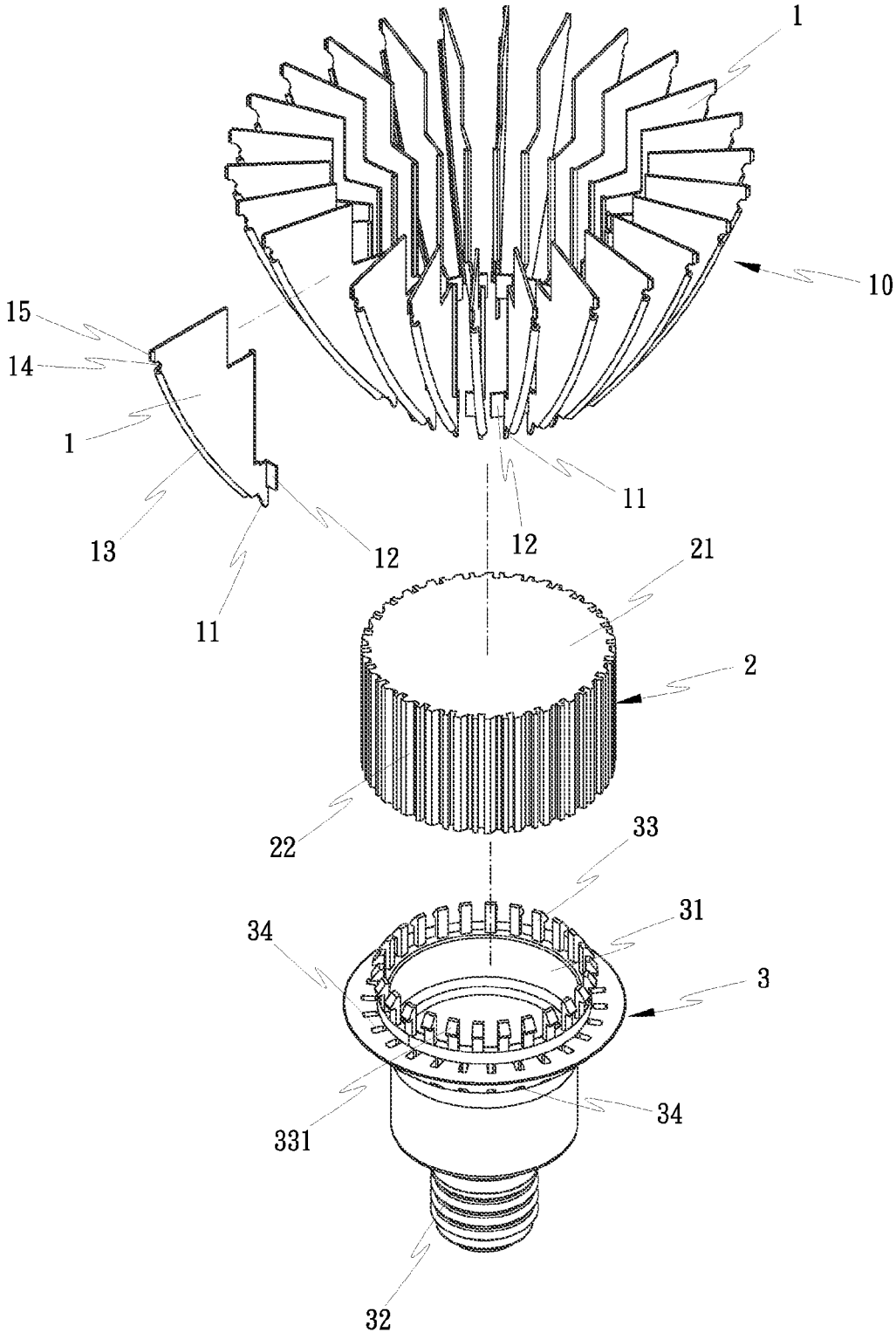
FIG. 1 is an exploded view according to a preferred embodiment of the present invention.
Figure 2:
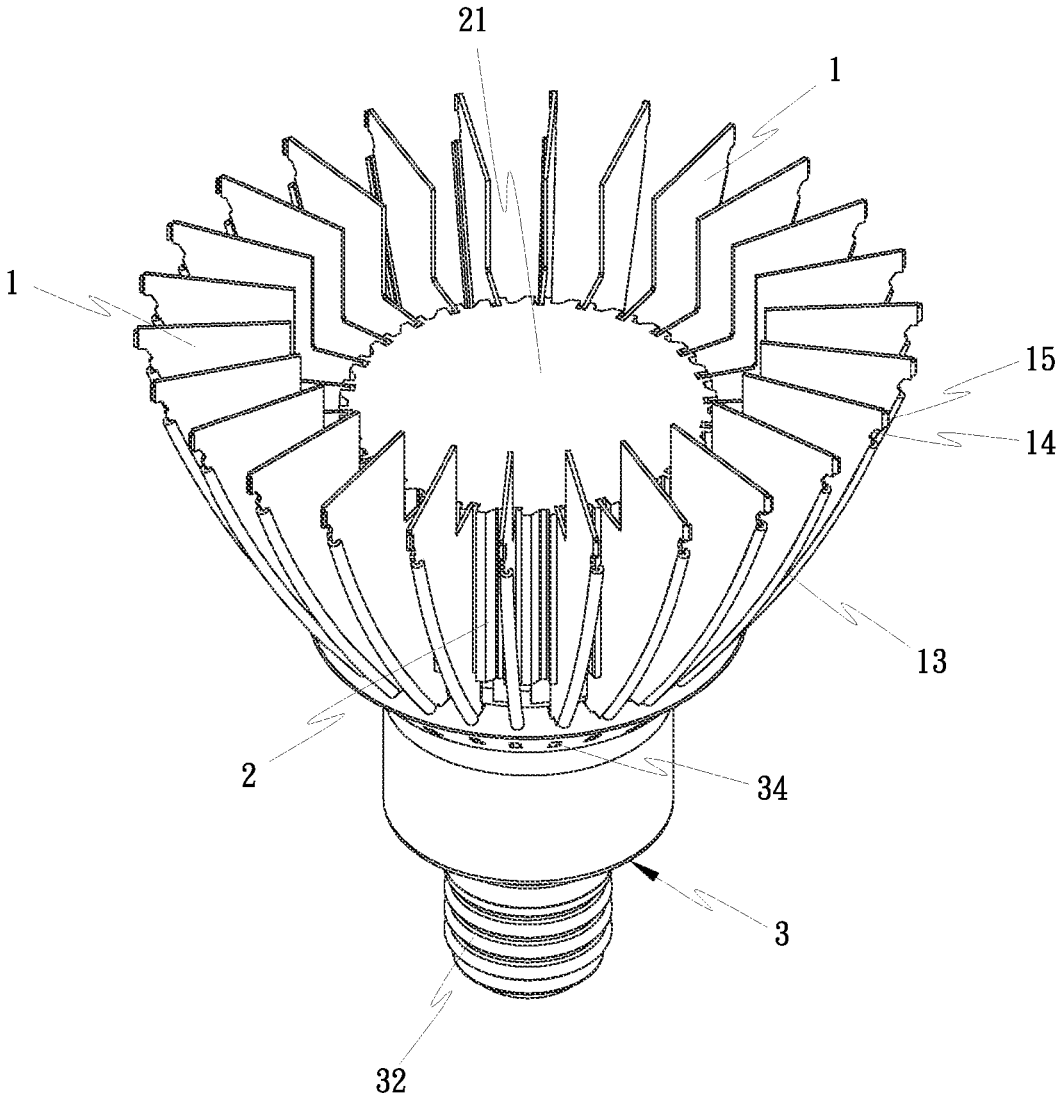
FIG. 2 is a perspective view according to the preferred embodiment of the present invention.
Figure 3:
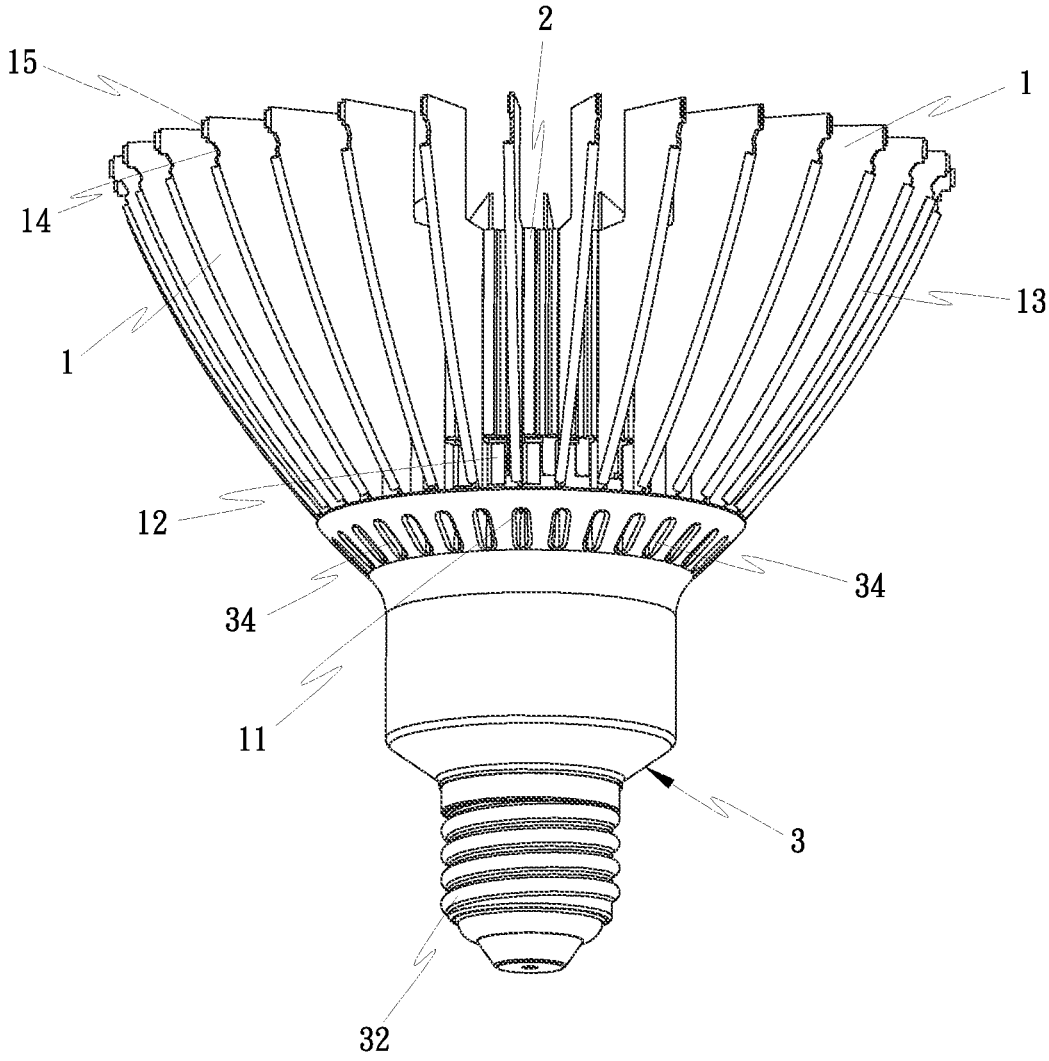
FIG. 3 is another perspective view seen from the bottom according to the preferred embodiment of the present invention.

As shown in FIG. 1 to FIG. 3, the connection structure of an LED lamp holder and heat radiation fins according to a preferred embodiment of the present invention comprises a heat radiation fin module 10, a heat radiation core pipe 2 and an insulation connector 3.

Figure 4:
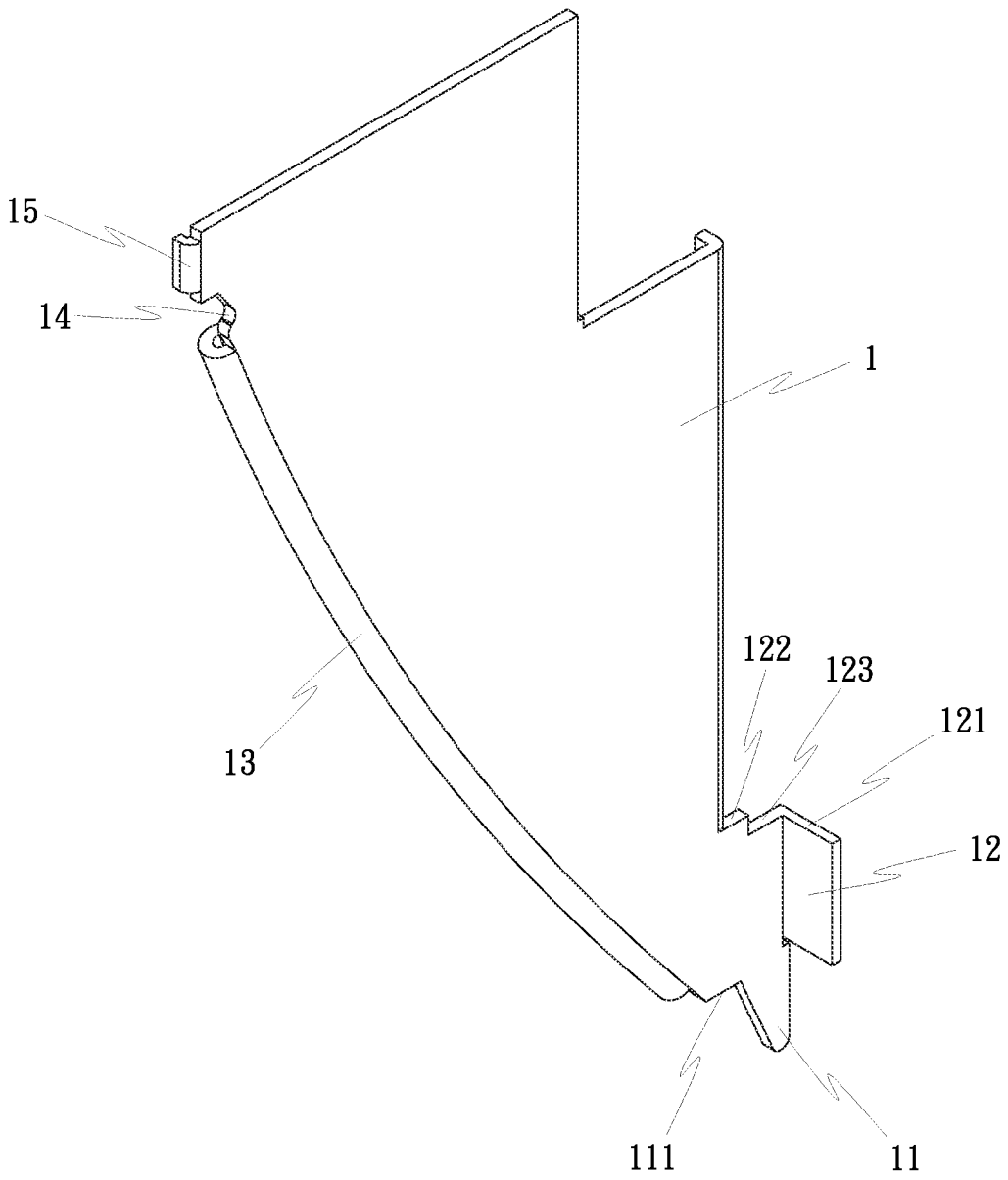
FIG. 4 is a perspective view of the heat radiation fin according to the preferred embodiment of the present invention.

The heat radiation fin module 10 comprises a plurality of heat radiation fins 1 surrounding the heat radiation core pipe 2. As shown in FIG. 4, each heat radiation fin 1 has an insertion portion 11 and a stop tab 12 at a distal end thereof. The stop tab 12 has an end surface 121.

The heat radiation core pipe 2 is a conventional member and comprises an illumination base containing a plurality of LEDs (not shown) on a top surface 21 thereof, which may be coupled with any combination of LED illumination units to enhance illumination effect.

The insulation connector 3 is a hollow housing. The insulation connector 3 has an opening 31 at an upper end thereof, a threaded portion 32 at a lower end thereof, and a plurality of engaging hooks 33 and engaging holes 34 around the opening 31 corresponding to the heat radiation fins 1.

Figure 5:
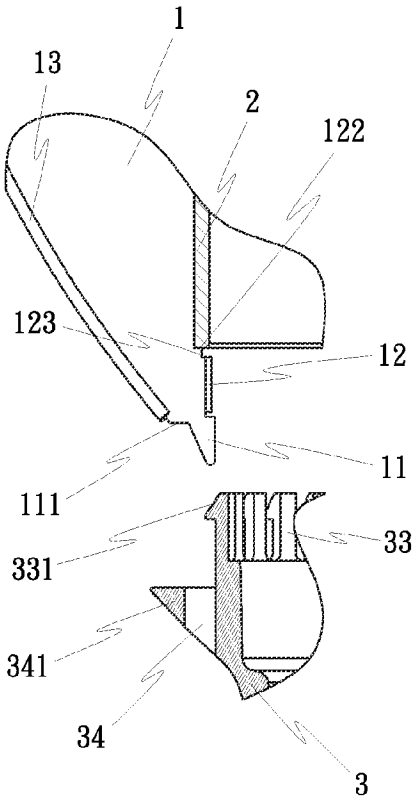
FIG. 5 is a sectional view showing that the heat radiation fin before it is inserted in the insulation connector according to the preferred embodiment of the present invention.
Figure 6:
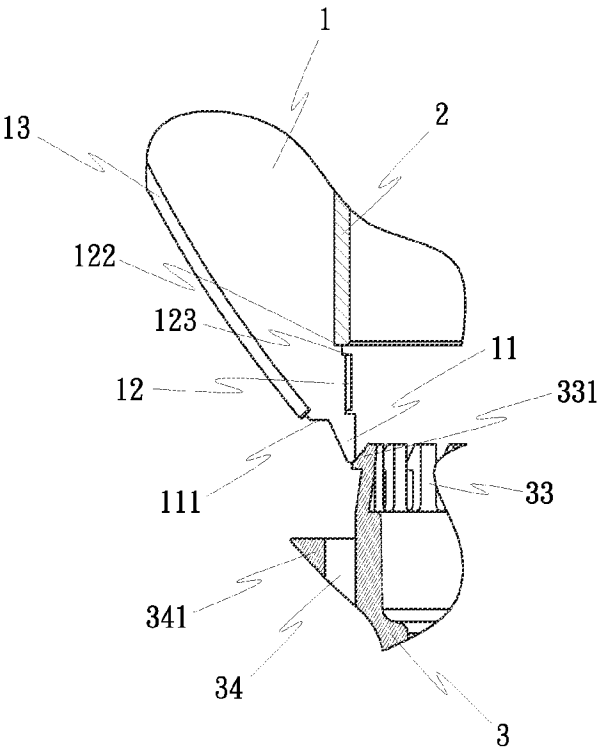
FIG. 6 is a sectional view showing that the heat radiation fin is being inserted in the insulation connector according to the preferred embodiment of the present invention.
Figure 7:
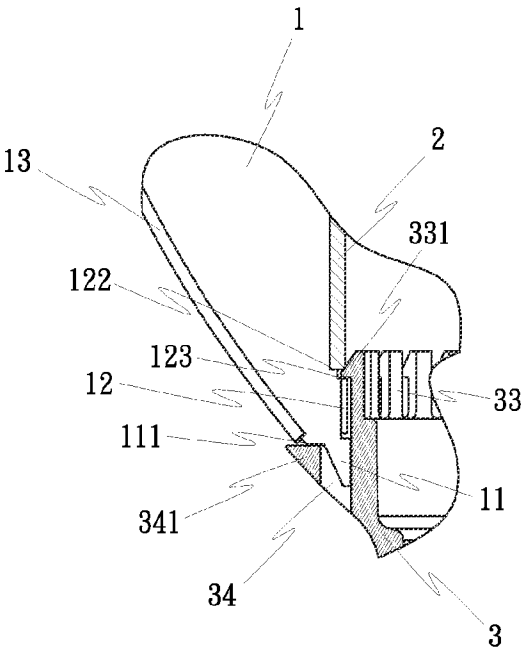
FIG. 7 is a sectional view showing that the heat radiation fin after it is inserted in the insulation connector according to the preferred embodiment of the present invention.
Figure 8:
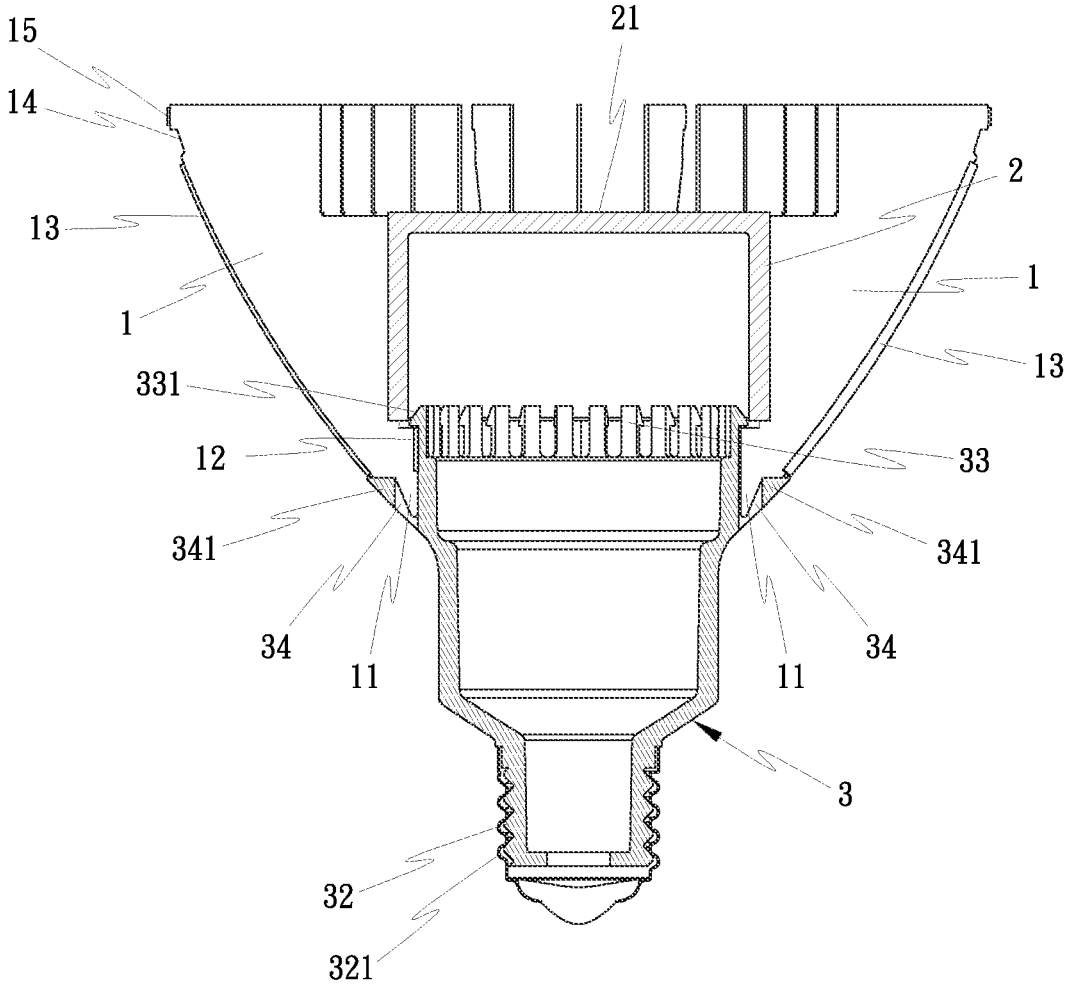
FIG. 8 is a sectional view according to the preferred embodiment of the present invention.

The heat radiation fins 1 are coupled to the heat radiation core pipe 2. The insertion portions 11 of the heat radiation fins 1 hold against the engaging hooks 33 and are inserted in the engaging holes 34 of the insulation connector 3. The end surface 121 of the stop tab 12 of each heat radiation fin 1 holds against the respective engaging hook 33, as shown in FIG. 5 to FIG. 7, to complete connection of the insulation connector 3 and the heat radiation module 10 quickly, as shown in FIG. 8.

Figure 9:
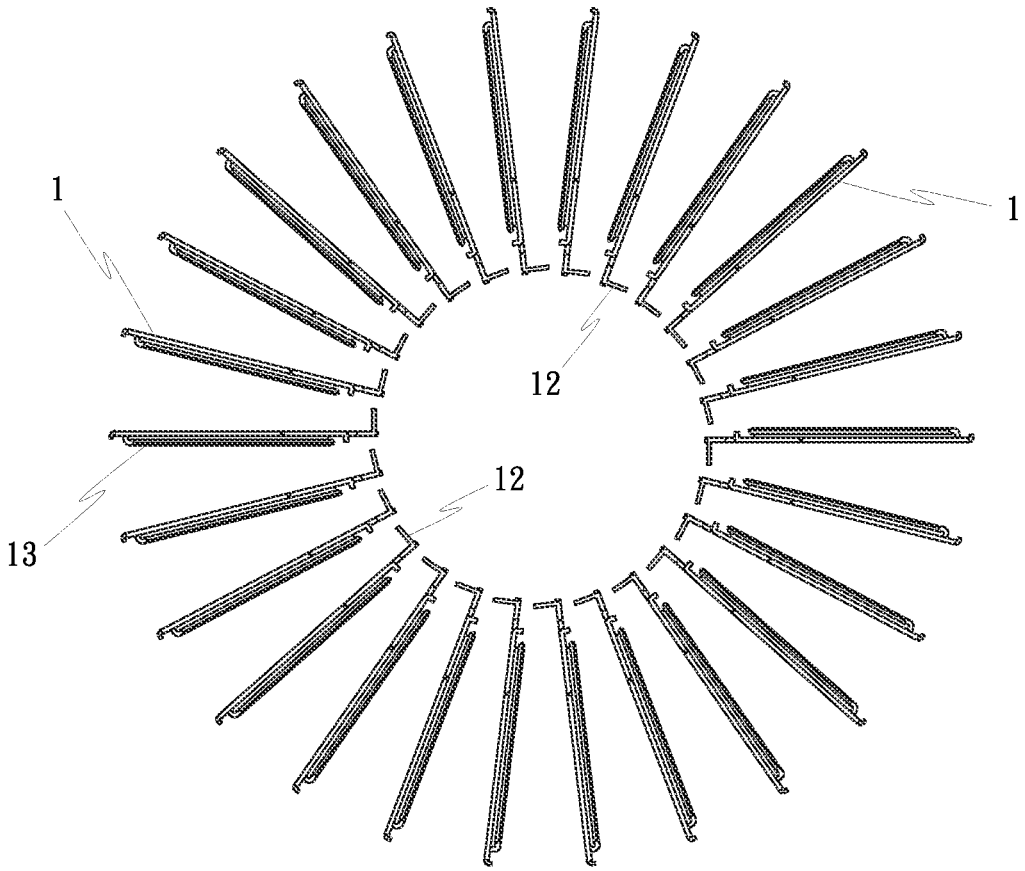
FIG. 9 is a top view showing the arrangement of the stop tabs of the heat radiation fins according to the preferred embodiment of the present invention.

The stop tab 12 of each heat radiation fin 1 is bent about 90 degrees, so that the end surface 121 of the stop tab 12 holds against the respective engaging hook 33 when the heat radiation fins 1 are engaged with the engaging hooks 33 of the insulation connector 3. In this way, each heat radiation fin 1 has a contact surface with the insulation connector 3. The area of the contact surface is larger than that of the conventional side contact point, providing a better connection effect. The stop tabs 12 of the heat radiation fins 1 surround the opening 31 of the insulation connector 3 with the end surfaces 121 of the stop tabs 12 to form an annular holding, as shown in FIG. 9. This can greatly increase the contact area of the heat radiation fin module 10 and the insulation connector 3 to achieve a stable engagement, and each heat radiation fin 1 won't be deformed as in the case when the engagement force is concentrated at a point.

The bent stop tab 12 of each heat radiation fin 1 may have a slightly curved surface to mate with the engaging hooks 33 which are arranged in a circle so as to form an annular holding.

As shown in the drawings of the preferred embodiment of the present invention, the connection of the heat radiation module 10 and the heat radiation core pipe 2 is not limited to any specific way of connection. As an example, the heat radiation fins 1 are respectively inserted and engaged in clamping grooves 22 of the heat radiation core pipe 2. The heat radiation fins 1 can be connected to the heat radiation core pipe 2 by welding. Alternatively, the heat radiation fins 2 may be integrally formed with the heat radiation core pipe 2.

The heat radiation core pipe 2 of the present invention may have an H-shaped cross-section so that it has a concave end surface for connection of the illumination base or the illumination unit. This is a traditional technique and won't be described hereinafter.

The insertion portion 11 of each heat radiation fin 1 of the present invention has a stepped surface 111. When the insertion portion 11 is inserted in the respective engaging hole 34 of the insulation connector 3, the stepped surface 111 is against an edge portion 341 of the respective engaging hole 34, as shown in FIG. 7. The stop tab 12 of each heat radiation fin 1 has an upper stepped surface 122 and an adjacent lower stepped surface 123. The upper stepped surface 122 is adapted to hold against the heat radiation core pipe 2. The lower stepped surface 123 is flush with the end surface 121 of the stop tab 12 and adapted to hold against a barb 331 of the respective engaging hook 33, as shown in FIG. 6 and FIG. 7.

Figure 10:
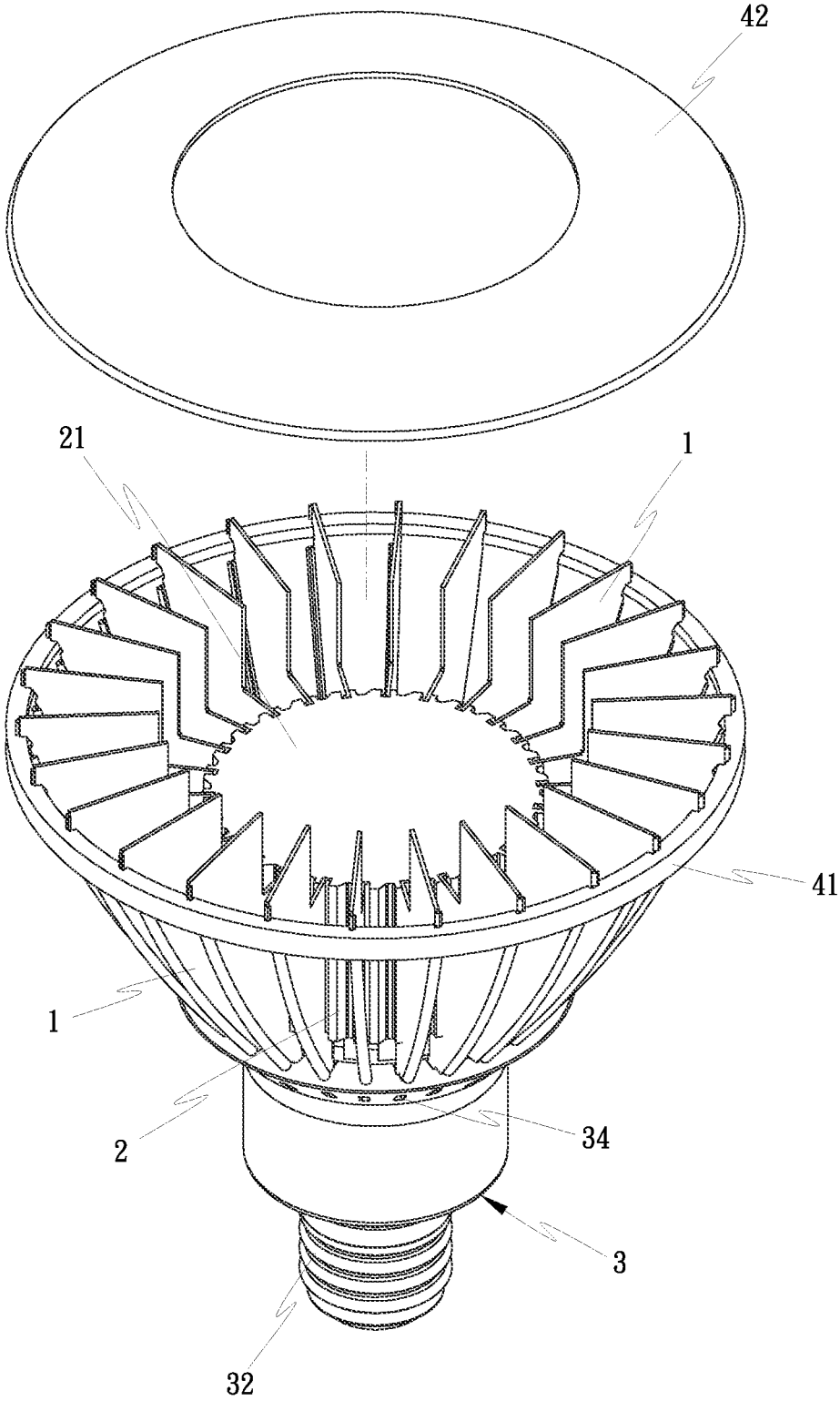
FIG. 10 is an exploded view showing the heat radiation module connected with the fastening ring and the transparent lid according to the preferred embodiment of the present invention.
Figure 11:
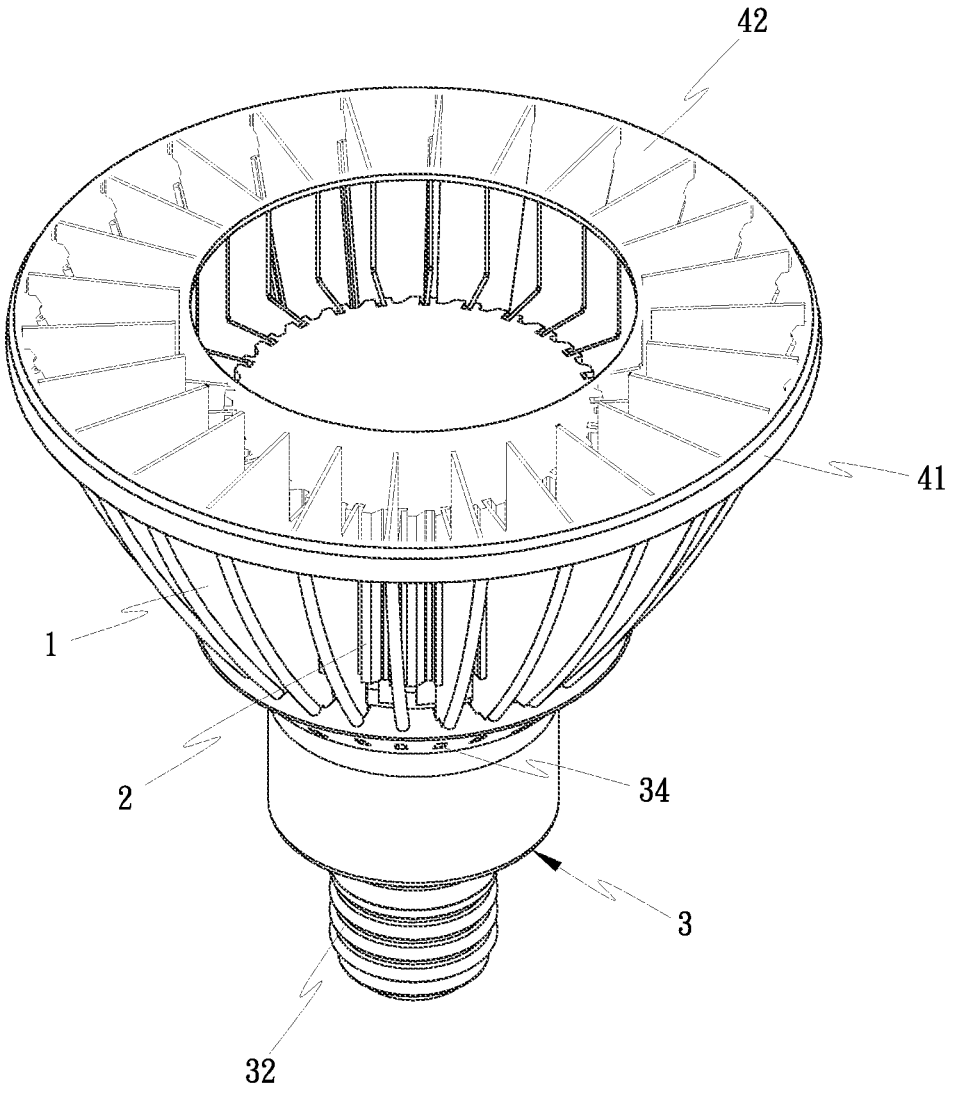
FIG. 11 is a perspective view of FIG. 9.
Figure 12:
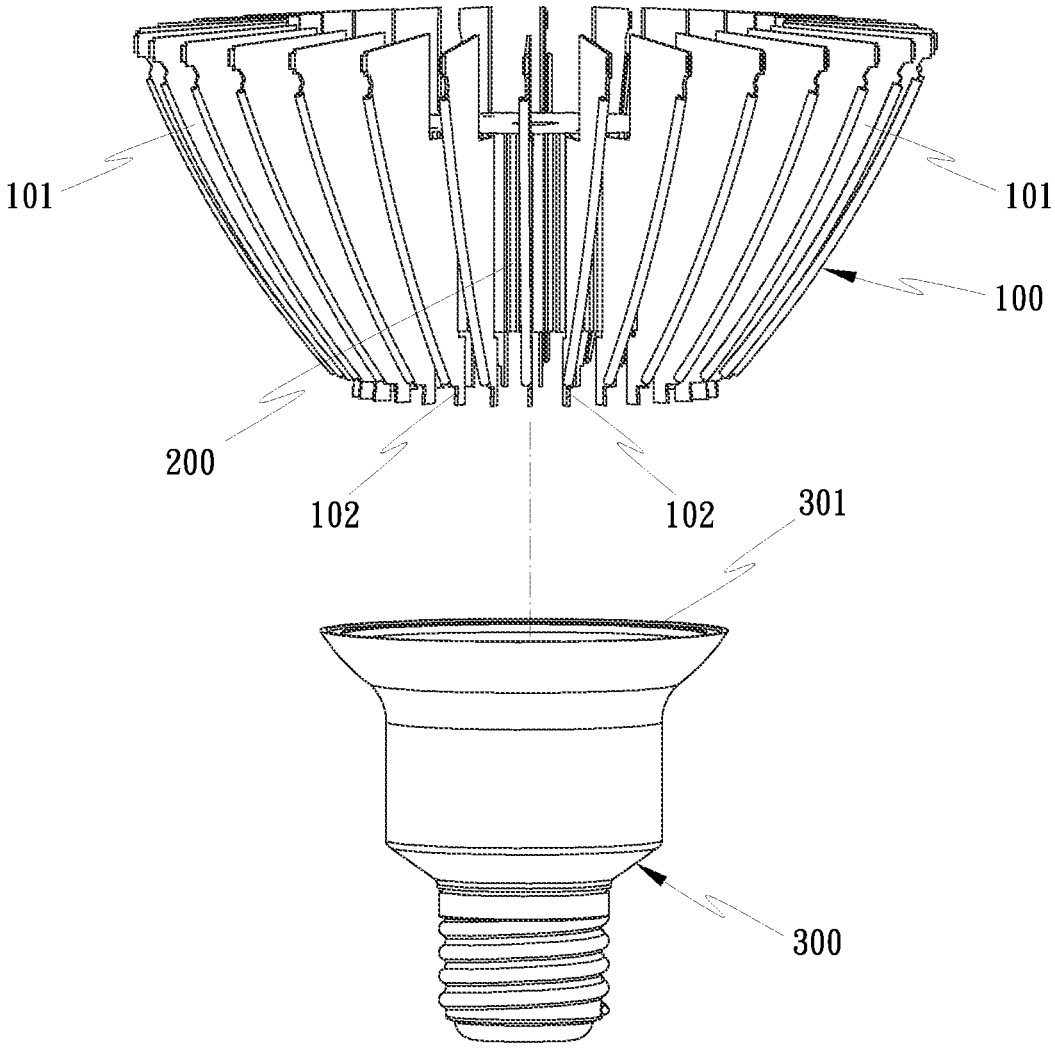
FIG. 12 Prior Art
FIG. 12 is an exploded view of a conventional LED lamp holder.
Figure 13:
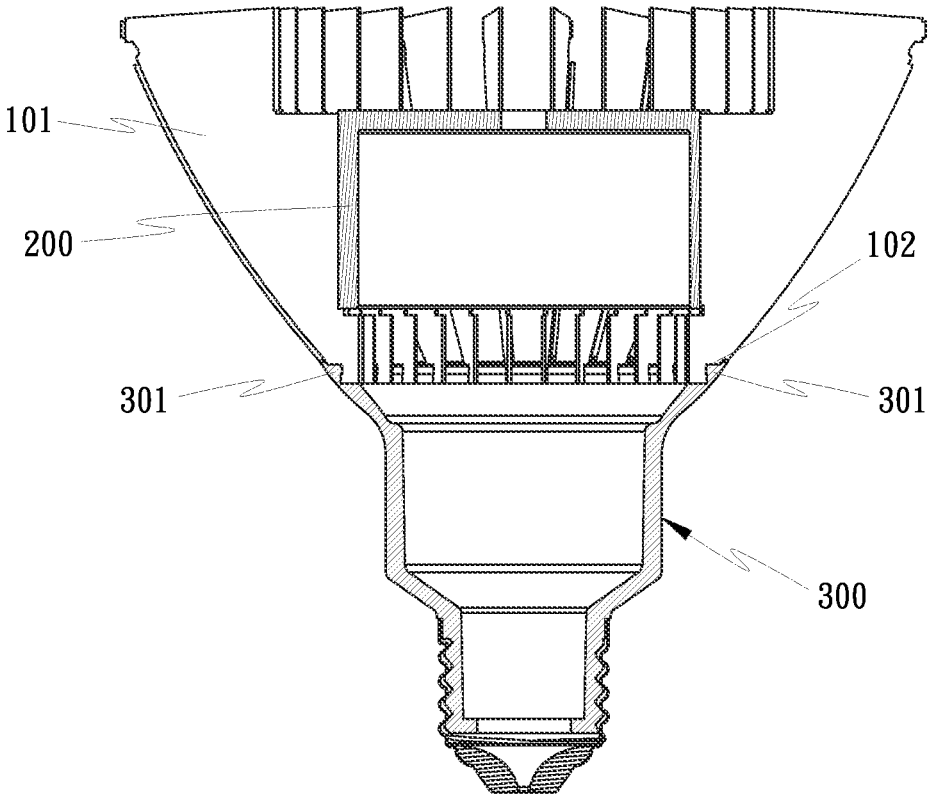
FIG. 13 Prior Art
FIG. 13 is a sectional view of the conventional LED lamp holder.

Each heat radiation fin 1 has an outer welting side 13 to prevent a sharp burr. The shape of the heat radiation fin 1 is not limited. As shown in FIG. 10 and FIG. 11, each heat radiation fin 1 has an engaging notch 14 and a hook piece 15 at a front end thereof for connection of a fastening ring 41. The fastening ring 41 is coupled with a transparent lid 42 by ultrasonic hot melting to form an LED lamp holder.

The threaded portion 32 of the insulation connector 3 is connected with a metallic conductive connector 321, as shown in FIG. 8, for electricity connection. This belongs to prior art.

Compared to the prior art, the connection structure of the LED lamp holder and the heat radiation fins has an improved and quick connection between the insulation connector and the heat radiation fins. The heat radiation fins are axially connected to the insulation connector firmly and won't be deformed. The heat radiation fins won't be displaced relative to the insulation connector.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A connection structure of an LED lamp holder and heat radiation fins, comprising a heat radiation fin module, a heat radiation core pipe and an insulation connector;

the heat radiation fin module comprising a plurality of heat radiation fins surrounding the heat radiation core pipe, each heat radiation fin having an insertion portion and a stop tab at a distal end thereof;

the heat radiation core pipe comprising an illumination base containing a plurality of LEDs;

the insulation connector being a hollow housing, the insulation connector having an opening at an upper end thereof, a threaded portion at a lower end thereof, and a plurality of engaging hooks and engaging holes around the opening corresponding to the heat radiation fins;

wherein the heat radiation fins are coupled to the heat radiation core pipe, the insertion portions of the heat radiation fins hold against the engaging hooks and are inserted in the engaging holes of the insulation connector, an end surface of the stop tab of each heat radiation fin holds against the respective engaging hook, so that the insulation connector and the heat radiation module are connected.

2. The connection structure of an LED lamp holder and heat radiation fins as claimed in claim 1, wherein the stop tab of each heat radiation fin is bent about 90 degrees.

3. The connection structure of an LED lamp holder and heat radiation fins as claimed in claim 1, wherein the stop tabs of the heat radiation fins surround the opening of the insulation connector with the end surfaces of the stop tabs to form an annular holding.

4. The connection structure of an LED lamp holder and heat radiation fins as claimed in claim 1, wherein the bent stop tab of each heat radiation fin has a slightly curved surface.

5. The connection structure of an LED lamp holder and heat radiation fins as claimed in claim 1, wherein the insertion portion of each heat radiation fin has a stepped surface to hold against an edge portion of the respective engaging hole.

6. The connection structure of an LED lamp holder and heat radiation fins as claimed in claim 1, wherein the stop tab of each heat radiation fin has an upper stepped surface and an adjacent lower stepped surface, the upper stepped surface being adapted to hold against the heat radiation core pipe, the lower stepped surface being flush with the end surface of the stop tab.

7. The connection structure of an LED lamp holder and heat radiation fins as claimed in claim 1, wherein each heat radiation fin has an outer welting side.

8. The connection structure of an LED lamp holder and heat radiation fins as claimed in claim 1, wherein each heat radiation fin has an engaging notch and a hook piece at a front end thereof for connection of a fastening ring, the fastening ring being coupled with a transparent lid by ultrasonic hot melting.

* * * * *